US006229494B1

(12) United States Patent
Merenda

(10) Patent No.: US 6,229,494 B1
(45) Date of Patent: May 8, 2001

(54) RADIATION SYNTHESIZER SYSTEMS AND METHODS

(75) Inventor: Joseph T. Merenda, Northport, NY (US)

(73) Assignee: BAE Systems Advanced Systems, Greenlawn, NY (US)

( * ) Notice: Subject to any disclaimer, the term of this patent is extended or adjusted under 35 U.S.C. 154(b) by 0 days.

(21) Appl. No.: 09/507,985

(22) Filed: Feb. 18, 2000

(51) Int. Cl.[7] ..... H01Q 1/26
(52) U.S. Cl. ..... 343/741; 343/701
(58) Field of Search ..... 343/876, 701, 343/741; 333/103

(56) References Cited

U.S. PATENT DOCUMENTS 4,092,610 5/1978 White et al. ..... 330/207 A
5,365,240 * 11/1994 Harmuth ..... 343/701
5,402,133 3/1995 Merenda ..... 343/701

* cited by examiner

*Primary Examiner*—Don Wong
*Assistant Examiner*—James Clinger
(74) *Attorney, Agent, or Firm*—Edward A. Onders; Kenneth P. Robinson

(57) ABSTRACT

Synthesizer radiating systems provide efficient wideband operation with an antenna, such as a loop, which is small relative to operating wavelength. Energy dissipation is substantially reduced by cycling energy back and forth between a high-Q radiator and a storage capacitor. Wideband operation is achieved by actively controlling power switch devices. Dissipation is further reduced during high speed switching by use of sequential switching methods to avoid dissipation of energy capacitively stored in switch capacitances, including switch control circuit capacitance. Systems using multi-segment loop antennas are arranged to match antenna input impedance to switching circuit parameters. Personal transmit/receive systems mounted on a jacket or other clothing for field use are enabled.

25 Claims, 10 Drawing Sheets

| | | | | | | |
|---|---|---|---|---|---|---|
| S1 | CLOSE | CLOSE | OPEN | OPEN | CLOSE | CLOSE |
| S2 | OPEN | OPEN | CLOSE | CLOSE | OPEN | OPEN |
| S3 | OPEN | CLOSE | CLOSE | CLOSE | CLOSE | OPEN |
| S4 | CLOSE | OPEN | OPEN | OPEN | OPEN | CLOSE |

| S1/S2 LOGIC | S1 | S2 |
|---|---|---|
| 1 | CLOSE | OPEN |
| 0 | OPEN | CLOSE |

| S3/S4 LOGIC | S3 | S4 |
|---|---|---|
| 1 | CLOSE | OPEN |
| 0 | OPEN | CLOSE |

| WAVEFORM REGION | S1/S2 | S3/S4 |
|---|---|---|
| A | 1 | 0 |
| B | 1 | TRANSITION |
| C | 1 | 1 |
| D | TRANSITION | 1 |
| E | 0 | 1 |
| F | 0 | 1 |
| G | 0 | 1 |
| H | TRANSITION | 1 |
| I | 1 | 1 |
| J | 1 | TRANSITION |
| K | 1 | 0 |
| L | 1 | 0 |

RADIATION SYNTHESIZER SYSTEMS AND METHODS

RELATED APPLICATIONS (Not Applicable)

FEDERALLY SPONSORED RESEARCH (Not Applicable)

BACKGROUND OF THE INVENTION

The present invention relates to radiating systems and, more particularly, to improved synthesizer radiating systems enabling efficient use of small high-Q antennas by active control of energy transfer back and forth between an antenna reactance and a storage reactance.

The theory and implementation of Synthesizer Radiating Systems and Methods are described in U.S. Pat. No. 5,402,133 of that title as issued to the present inventor on Mar. 28, 1995. That patent ("the '133 patent") is hereby incorporated by reference.

A basic radiation synthesizer circuit, as described in the '133 patent, which combines transfer circuits in both directions using two switches is shown in FIG. la. This circuit functions as an active loop antenna where the loop antenna L is the high Q inductive load and a capacitor C is used as the storage reactor. The FIG. la circuit uses two RF type switching transistors, shown as switches RC and DC, for rate and direction control, respectively. Because the devices are operated in a switch mode, efficient operation is obtained since, in theory, no instantaneous power is ever dissipated by such devices. A slower switching device, shown as power control switch PC, can be used to add energy to the circuit from the power supply as energy is radiated. The voltage and current sensor terminals VS and CS, respectively, are used to monitor and calculate the total amount of stored energy at any instant in time, while a feedback control circuit is used to maintain the total energy at a preset value through use of the power control switch PC.

In the FIG. la circuit, when the direction control switch is open, energy can be transferred from current through the inductor L to voltage across the capacitor C, as illustrated by the L to C energy transfer diagram of FIG. 1*b*. With the rate control switch closed, current flows from ground, through diode D1 and L, and back to ground through the rate control switch RC. In the absence of circuit losses, the current would continue to flow indefinitely. When the rate control switch RC is opened, the inductor current, which must remain continuous, flows through diode D2 and charges up the capacitor C. The rate at which C charges up is determined by the switch open duty cycle of the switch RC. The capacitor will charge up at the maximum rate when the switch is continuously open. The charging time constant is directly proportional to the switch open duty cycle of the rate control switch RC.

When the direction control switch DC of FIG. 1*a* is closed, energy can be transferred from voltage across the capacitor to current through the inductor, as shown in the C to L energy transfer diagram of FIG. 1*c*. Diode D1 is always back biased and is, therefore, out of the circuit. When the rate control switch RC is closed, the capacitor C will discharge through L, gradually building up the current through L. If the rate control switch is opened, the capacitor will maintain its voltage while the inductor current flows in a loop through diode D2. In this C to L direction transfer mode, the rate is controlled by the switch closure duty cycle of switch RC. The maximum rate of energy transfer occurs when the switch RC is continuously closed. Its operation is the inverse of that in the other direction transfer mode (L to C).

It should be noted that, in either direction, charge or discharge is exponential. Therefore, the rate of voltage or current rise is not constant for a given rate control duty cycle. In order to maintain a constant rate of charging (ramp in voltage or current), it is necessary to appropriately modulate the duty cycle as charging progresses. Duty cycle determinations and other aspects of operation and control of radiation synthesizer systems are discussed at length in the '133 patent (in which FIGS. 1*a*, 1*b* and 1*c* referred to above appear as FIGS. 8*a*, 8*b* and 8*c*).

In theory, since the power which is not radiated is transferred back and forth rather than being dissipated, lossless operation is possible. However, as recognized in the '133 patent losses are relevant in high frequency switching operations, particularly as a result of the practical presence of ON resistance of switch devices and inherent capacitance associated with switch control terminals. While such device properties are associated with very small losses of stored energy each time a switch is closed, aggregate losses can become significant as high switching frequencies are employed. In addition, if small loop antennas are to be employed, for example, antenna impedance may be higher than basic switching circuit impedance levels, necessitating use of impedance matching circuits which may have less than optimum operating characteristics.

Continuing work with synthesizer radiating systems and methods has indicated the desirability of further development and improvement in respect to the above and other aspects of implementation and operation of such systems and methods.

Objects of the present invention are, therefore, to provide new and improved synthesizer radiating systems and methods and subsets thereof, particularly such as provide one or more of the following advantages and capabilities:

- reduction of dissipation of stored energy in switch device ON resistance;
- reduction of dissipation of energy stored in power switch control circuits;
- provision of sequential switching methods;
- reduction of dissipation of stored energy via sequential switching circuits; and
- reduction of antenna impedance by provision of multi-segment loop radiator systems.

SUMMARY OF THE INVENTION

In accordance with the invention, a synthesizer radiating system, wherein energy is transferred back and forth between an inductive antenna element and storage capacitance by controlled activation of switching circuits, may employ each of the following three aspects of the invention.

I. A multi-segment loop radiator system including:

- a loop antenna element configured as a plurality of successive loop segments; and
- a like plurality of switching circuits each coupled to a different pair of loop segments. Each switching circuit includes power switch devices arranged for controlled activation to transfer energy back and forth from the loop segments to which it is coupled to a portion of said storage capacitance.

II. A driver circuit usable to change states of a selected power switch device including:

first and second driver switch devices in a series arrangement suitable for connection across a potential and having a common point between the driver switch devices; and an inductive element coupled at one end to such common point and arranged for a second end to be coupled to a control terminal of the selected power switch device for use in changing states thereof between open and closed states.

III. A sequential switching method including the steps of (a) initially providing one power switch device in an open state with a voltage across it and energy capacitively stored therein (the "open switch"), (b) initially providing another power-switch device in a closed state (the "closed switch") and coupled to the open switch device so that the state of the closed switch affects the voltage across the open switch, (c) reducing the voltage across the open switch by changing the state of the closed switch from closed to open, and (d) changing the state of the open switch from open to closed at a predetermined time after changing the state of the closed switch in step (c).

For a better understanding of the invention, together with other and further objects, reference is made to the accompanying drawings and the scope of the invention will be pointed out in the accompanying claims.

DESCRIPTION OF THE INVENTION

Figure 1A:
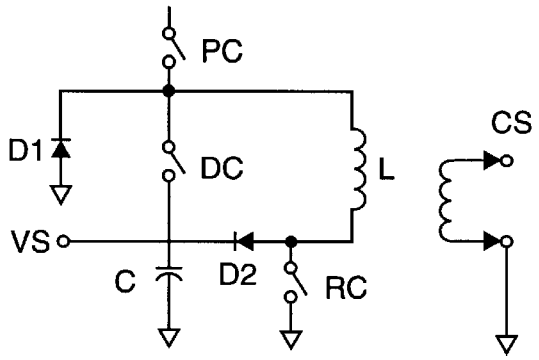
FIG. 1a PRIOR ART
FIGS. 1*a*, 1*b* and 1*c* are simplified circuit diagrams useful in describing operation of prior art synthesizer radiating systems.
Figure 1B:
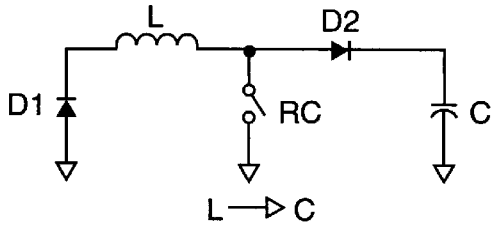
FIG. 1b PRIOR ART
Figure 1C:
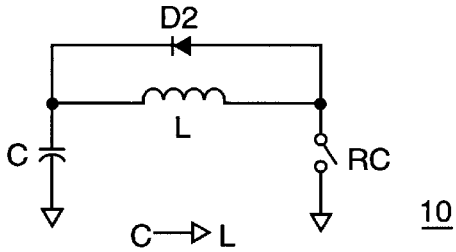
FIG. 1c PRIOR ART
Figure 2:
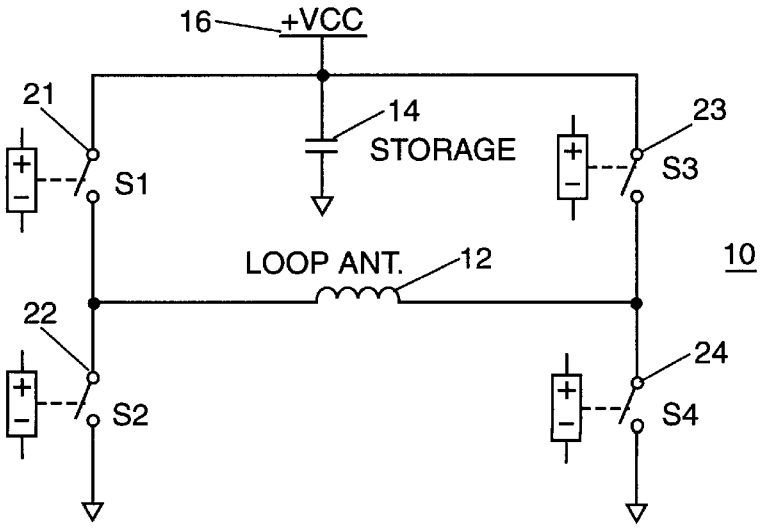
FIG. 2 shows a synthesizer radiating system pursuant to the invention.
Figure 3:
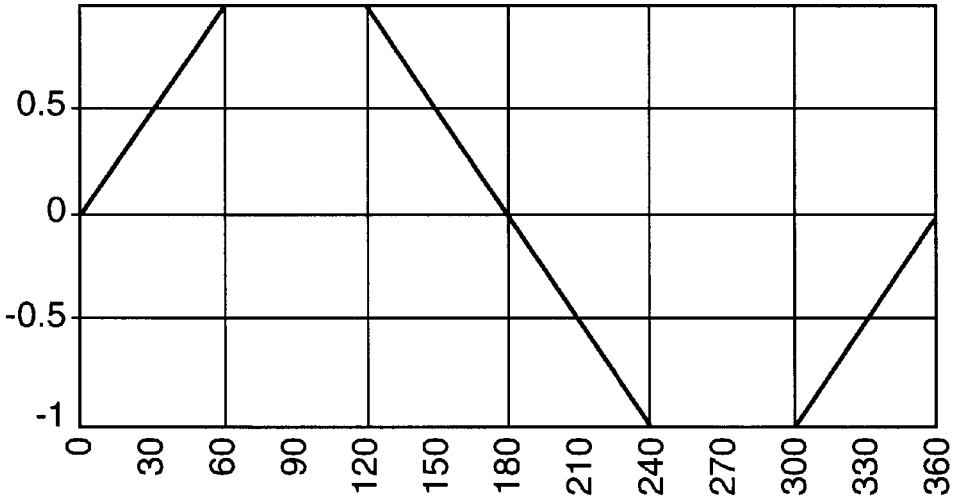
FIG. 3 provides a switch state table useful in describing operation of the FIG. 2 system in synthesizing a selected sinusoidal-type waveform.

The basic synthesizer radiating system loop-antenna circuit discussed above can be reduced to the simplified ideal model shown in FIG. 2. This model replaces the diodes in the basic circuit by ideal switches, and provides push-pull operation (current can flow in either direction through the loop antenna). The push-pull, or bipolar circuit, is more efficient than the single-ended circuit by a factor of 2 (3 dB). The FIG. 2 system includes four power switch devices comprising a switching circuit pursuant to the invention, a complete implementation of which will be described with reference to FIG. 14. As illustrated, the FIG. 2 system includes loop antenna 12, storage capacitor 14 and power switch devices 21, 22 23 and 24, which will also be referred to as switches S1, S2, S3 and S4, respectively. The switch states during various phases of a sinusoidal-type waveform are illustrated in FIG. 3 by way of example. Three possible states exist: linear charging of inductor current, linear discharging, and constant current. It is possible to synthesize any waveform using this circuit, with waveform fidelity dependent on sampling speed. For an arbitrary waveform and an acceptable level of waveform distortion, it has been determined that a sampling rate equal to at least four times the highest frequency component in the waveform will generally be adequate. It should be noted that, with an understanding of the invention, alternative switching schemes may be employed. For example, in FIG. 3 switching states which are the respective opposites of those listed in the second and fourth columns are usable in providing the desired flat portions of the illustrated waveform.

For near-sinusoid current waveforms some important antenna equations include:

$$\text{V-peak}=V_{CC}=V$$

$$\text{I-peak}=V/Z$$

$$\text{Peak Reactive Power (PRP)}=VI=V^2/Z=I^2Z$$

$$\text{Radiated Power}=\tfrac{1}{2}\text{PRP}/Q$$

where Z is equal to the antenna reactance in ohms, and Q is equal to the antenna Q. The antenna Q is defined in terms of antenna size by:

$$Q=1/(7S^3)$$

where S is the length of one side of a square loop in wavelengths.

It should be noted that Z is not necessarily equal to the reactance of the square loop, but is the impedance as seen by the switching circuit. It includes the effect of any impedance transformer inserted between the circuit and the antenna terminals.

Figure 4:
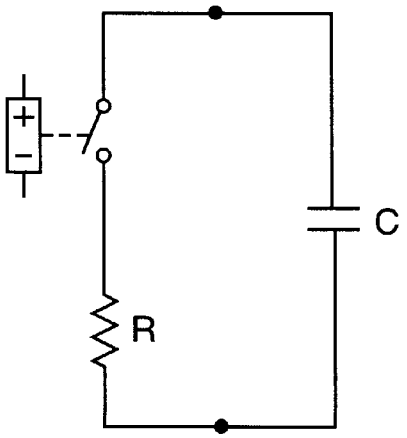
FIG. 4 is a simplified circuit model of switch characteristics.

A simple model for any one of switches 21–24, which can be used to evaluate its impact on the system performance, is shown in FIG. 4. When the switch is closed, it can be modeled as a series resistance, and when it is open, it can be modeled as a capacitor. Values for both characteristics are generally specified in the data sheets for solid-state switching devices.

Figure 5:
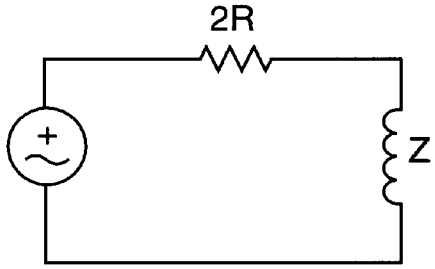
FIG. 5 is a simplified circuit model of the FIG. 2 system useful in considering circuit dissipation.

The direct loss contribution from the series resistance (the "ON resistance") is easy to evaluate. From the FIG. 2 circuit model with ideal switches and the FIG. 3 switch state table, it can be seen that, in all states, there are two closed switches in series with the antenna. Hence, for purposes of circuit dissipation evaluation, the entire system can be modeled as the transformed antenna reactance in series with twice the switch resistance, as shown in FIG. 5. As a result, for a sinusoidal-type waveform, the circuit power dissipation is equal to:

$$\text{Power-diss}=I^2R$$

where I is the peak antenna current.

A more insidious form of dissipation occurs in the switch resistance, but is caused by the parasitic capacitance. Synthesizer radiating systems utilize energy-storage in reactive elements and high-efficiency depends on transfer of energy from one reactance to another, rather than dissipation of non-radiated energy during each RF cycle. Energy is also stored in the switch capacitance and, whenever a switch closes, that energy will be dissipated by the switch resistance. It is irrelevant how fast the switch is made to close. Just before switch closure, energy is stored in the voltage-charge on the capacitor, and, after closure and discharge, the capacitor voltage and its energy are equal to zero. Basic physics (conservation of energy) demands total dissipation of the stored energy, independent of the speed of switch closure.

The stored energy is equal to:

$$E=\tfrac{1}{2}CV^2$$

Power is defined as the rate of energy dissipation and, from an inspection of the basic system circuit, there are always two switch capacitances in parallel, yielding the equation for power dissipated from charged switch capacitance:

$$\text{Power-diss}=CV^2F_S$$

Where $F_S$ is the antenna switching or sampling rate. The total circuit power dissipation is the sum of the two contributions discussed, and is equal to:

$$\text{Power-diss}=I^2R+CV^2F_S$$

Trapezoidal Sequential Switching

Figure 6:
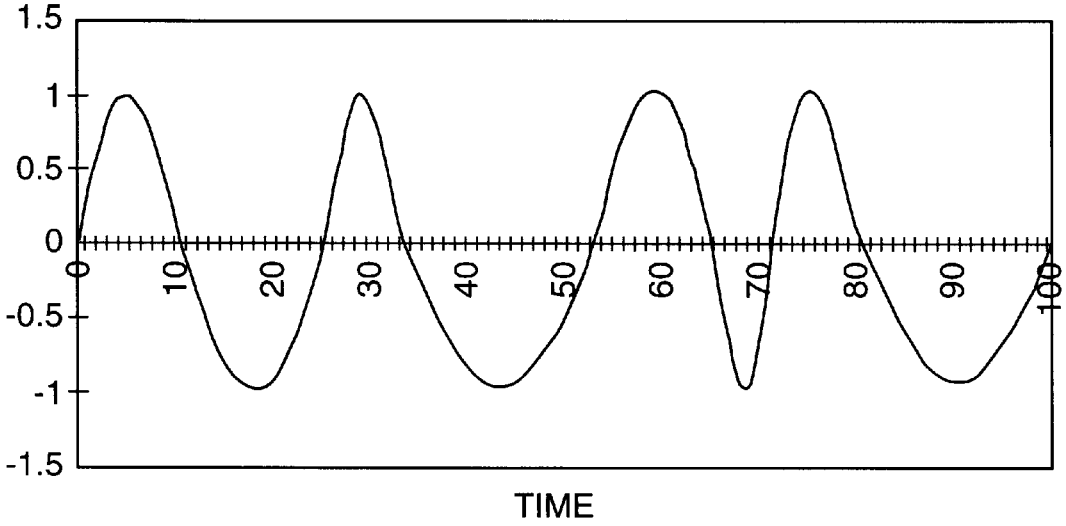
FIG. 6 illustrates a typical communication waveform.

A typical modern communications waveform is illustrated in FIG. 6. The waveform is constant envelope, i.e., the peak current or voltage of each sinusoidal lobe is always the same, and there are no abrupt phase changes. The waveform exhibits a wide frequency content because the time between zero-crossings will vary by a large amount over time. The wide frequency content offers advantages in link margin, and enables LPI (low probability of interception) operation. The constant envelope, in conjunction with the lack of abrupt phase discontinuities, help provide the "featureless" attribute that maximizes LPD (low probability of detection) and LPE (low probability of exploitation) performance.

Figure 7:
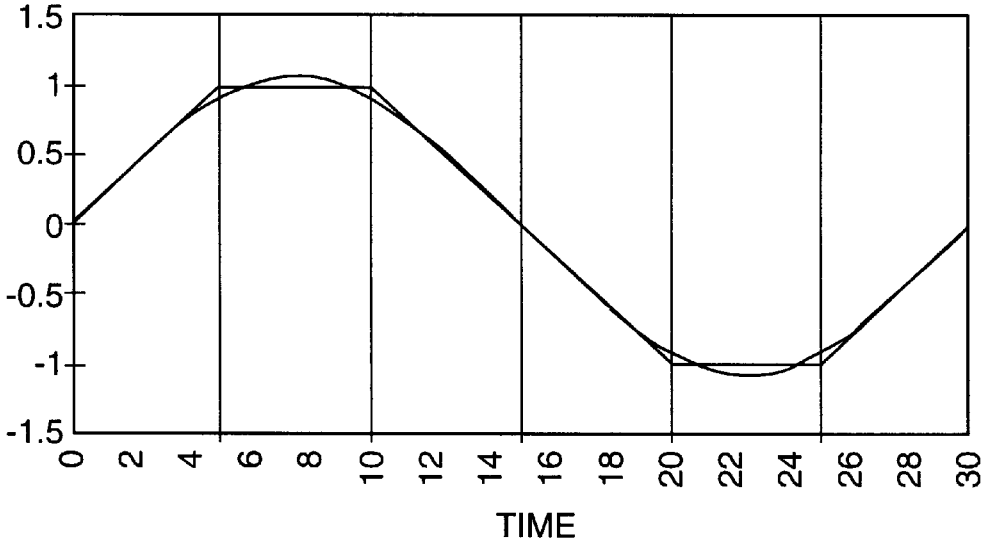
FIG. 7 illustrates approximation of a sinusoidal lobe by a trapezoid form.

Each sinusoidal lobe can be approximated by the trapezoid shown by straight line segments in FIG. 7. The total harmonic distortion is less than 0.5%. The trapezoidal function only exhibits odd harmonics, and the third harmonic can be eliminated by careful selection of the point of transition in the waveform, as shown. The lack of lower order harmonics enables one to operate over at least an octave instantaneous bandwidth, while employing a harmonic suppression filter, if needed. Furthermore, the sequential switch algorithm that will be described below, smooths the sharp corners of the trapezoid, further reducing spurious levels, and most likely, eliminates the need for any filter. Another benefit is the resulting ease of waveform synthesis.

Pursuant to the invention, a trapezoidal sequential switching ("TSS") algorithm is provided to eliminate dissipation caused by switch capacitance. Not only is performance substantially improved, but also the optimum antenna impedance is raised to a more practical value.

Figure 8:
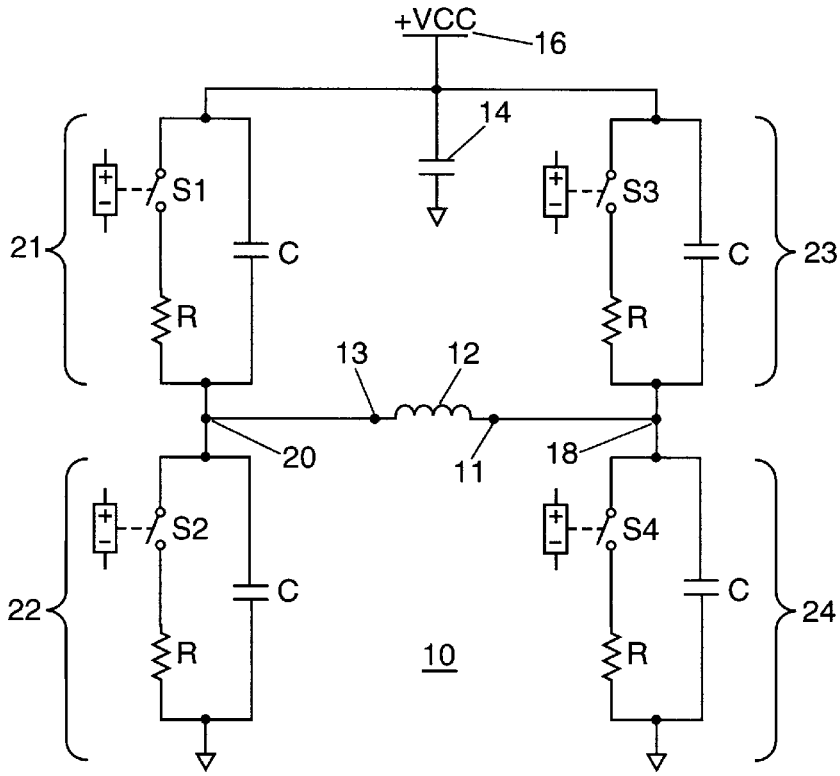
FIG. 8 is a representation of the FIG. 2 system with inclusion of switch circuit characteristics.
Figure 8A:
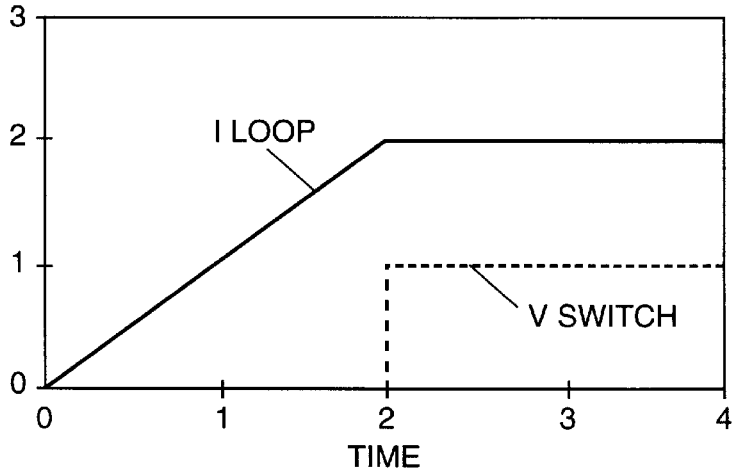
FIG. 8*a* illustrates basic operation of the FIG. 8 system for a half-sinusoidal pulse.

In describing the TSS algorithm, there will first be considered the switching circuit of FIG. 8 as it progresses through a half-sinusoidal pulse without the benefit of sequential switching pursuant to the invention. At $t=0^-$, the loop current is equal to 0. At t=0, switches S1 and S4 are closed, and the inductor current ramps up (see FIG. 8*a*). At $t=t_2$, switch S3 closes while S4 simultaneously opens. The voltage across the inductor is now equal to 0, the loop current remains constant at a value equal to that at $t_2^-$, and the flat-top portion of the trapezoidal approximation to the sinusoidal pulse begins. At this transition time, energy dissipation results from the charge on the switch capacitance of S3. At $t=t_2^-$, the full supply voltage is across S3, while at $t_2^+$, the voltage across S3 will be 0. Therefore, all the energy stored in S3's capacitance will be dissipated by it's ON resistance.

Figure 8B:
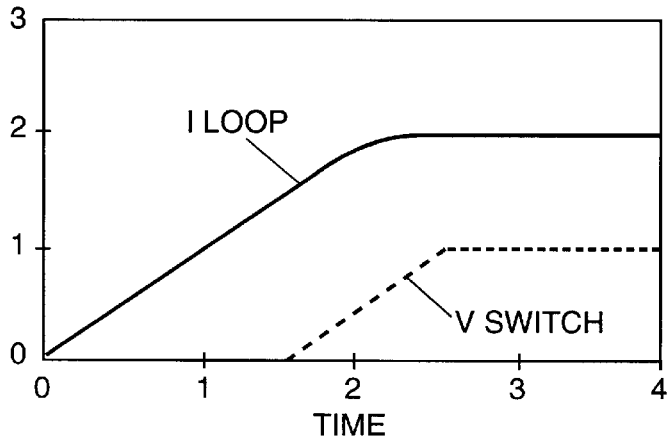
FIG. 8*b* illustrates operation of the FIG. 8 system using a sequential switching method in accordance with the invention.

In accordance with the invention, instead of simultaneously changing the state of two switches, switching is sequential. For example, with reference to FIG. 8, the following sequential switching method may be employed. Instead of simultaneously closing switch S3 and opening switch S4 at time $t_2$ as above, at an appropriate time before $t_2$, open S4 (see FIG. 8*b*). The current continues to flow through the inductor, and begins charging up the total capacitance of S3 and S4 in parallel. As the capacitors charge, the voltage across the inductor falls, and the rate at which the inductor current is rising begins to slow down. Finally, at some later time (approx. $t=t_{2.5}$), the capacitors have charged to the full supply voltage, the inductor current has stopped rising, and the voltage across S3 is equal to 0. At this time, S3 can be closed without dissipating any energy. In addition, the gradual transition in inductor current waveform from a ramp to a constant value, more closely approximates the sinusoidal pulse, and results in lower spurious harmonics. A similar sequential switching process can be followed at each of the break-points in the trapezoid, to eliminate switch capacitance energy dissipation. In all cases, the shorted-switch is opened before it's counterpart is closed, allowing the switch capacitance to discharge.

In light of the foregoing discussion, a sequential switching method for use in the FIG. 8 synthesizer radiating system 10 may be characterized as follows. In basic operation of system 10 energy is transferred back and forth between an inductive antenna element 12 and a storage capacitance 14 by controlled activation of switch devices, including third and fourth switch devices 23 and 24 in series across a voltage source 16 with a common point 18 between said switch devices coupled to a point on the antenna element 12 (e.g., first end 11 thereof). An embodiment of the sequential switching method comprises the steps of:

(a) initially providing one switch device (e.g., the third switch device 23) in an open state with a voltage across it and energy capacitively stored therein;

(b) initially providing another switch device (e.g., the fourth switch device 24) in a closed state;

(c) changing the state of the fourth switch device 24 from closed to open to thereby reduce the voltage across the third switch device 23; and (d) a predetermined time after step (c), changing the state of the third switch device 23 from open to closed.

With reference to the FIG. 8 system, there are also included first and second power switch devices 21 and 22 in series across the voltage source 16 with a common point 20 between the first and second switch devices coupled to a second point on the antenna element (e.g., second end 12). In the described sequential switching method, step (a) additionally comprises initially providing the first and second switch devices 21 and 22 in respective closed and open states. More generally, regarding operation of all four switch devices 21–24, the sequential switching method may be stated as including the additional step of:

(e) during operation of the system, before closing any one of the first, second, third and fourth power switch devices 21–24, opening a different one of the power switch devices in a sequential manner consistent with steps (c) and (d) to reduce voltage across the switch device to be closed, before it is closed.

It is useful to consider why current considerations are limited to the trapezoidal waveform, and whether greater resolution in waveform synthesis could be achieved by using a sloped-staircase approximation. Consider an attempt to slow down the effective rate of current rise by switching to a constant for a period of time, and then start the increasing ramp again at some later time. It has already been shown possible to transition from the increasing ramp to the constant waveform. For the sloped-staircase objective, an attempt could be made to transition from the constant current back to an increasing ramp. To accomplish this, it would be necessary to switch back to the condition of switch S3 open and switch S4 closed. Consistent with the prior discussion, open S3 before closing S4. Unfortunately, the positive inductor current then charges up S4's voltage to a value greater than the supply, thereby increasing the stored capacitive energy, and exacerbating the problem. In fact, there is no known way to discharge the capacitor prior to switch closure for this type of waveform transition. It is possible to cycle from constant current to a rising ramp only when the current is negative, as in the bottom portion of a trapezoidal approximation to the sinusoid.

Using the simple circuit there is also a constraint on the particular current amplitude for each frequency component. Since the current rise-time cannot be slowed down by using the sloped-staircase approximation, the peak value is constrained by the period of time that the ramp portion is activated, and by the supply voltage. Since the ramp time is also constrained by the period of the sinusoidal pulse, there is no current amplitude flexibility on a pulse-by-pulse basis. Of course long-term power control could be implemented simply by lowering the supply voltage.

It should be noted that the invention can also be used with non-constant envelope waveforms (e.g., multi-tone transmissions) by using a more complex switching circuit. The circuit would typically contain many sets of switches corresponding to the S1/S3 switch pair, each set tying to a different voltage. At a given point in time only the appropriate S1/S3 set would be activated, depending on the amplitude of the particular pulse, while all other switch sets remain open. In the design of such a system, a skilled worker would take into account the excess capacitance of all the unused switches hanging in parallel.

In application of the invention, consideration can be given to evaluation of limits on TSS performance and whether there is an optimum antenna impedance. As described, the circuit operates by using inductor current to discharge switch capacitance prior to switch closure. That discharge must happen fast enough so that the switching function can follow the desired waveform. When driving a high impedance, the circuit voltage will be large, and the loop current will be small. Not only is the rate of capacitor charge slow (low current), but it must charge to a higher voltage. Therefore, if the impedance is too high, the circuit will not respond fast enough. On the other hand, if the impedance is very low the circuit will respond faster than needed, and $I^2R$ losses will be very high. There thus exists an optimum impedance for which the circuit responds just fast enough.

In order to quantify the optimum impedance level, it is necessary to compute the capacitive discharge time and set it equal to the desired switching speed. The maximum switching speed tolerable in transitioning from one portion of the trapezoid to another is about one radian.

$$T_{SWITCH}=1/(2piF_{RF})$$

The time it takes to charge a capacitor is represented approximately as follows. This equation assumes a constant charging current which does not pertain here, however, a sufficiently accurate charging time with error less than twenty percent is determined.

$$T_{CHARGE}=VC/I$$

By equating the two times, the optimum impedance is provided.

$$\text{Impedance}=V/I=1/(2piF_{RF}C)$$

The optimum impedance is simply equal to the reactance of the switch capacitance in this case, because two switches are always in parallel.

$$Z_{OPT}=1/(4piF_{RF}C)$$

If the sequential switching times are optimized, the dissipation caused by capacitance is eliminated, and the total circuit dissipation is:

$$P_{DISS}=I^2R=(PRP)R/Z_{OPT}=(PRP)4piRCF_{RF}$$

When operating over a wide band, the switching time constraint is driven by the highest frequency. Therefore, the optimum impedance will be the capacitive reactance at the highest frequency, and the impedance will be lower than optimum at lower frequencies.

In system designs pursuant to the invention, as various operating and loss factors are optimized or eliminated, performance improvement will ultimately be limited by remaining spurious resistive losses. The primary spurious loss mechanism will thus typically be represented by the resistivity of the conductors of the loop antenna. In practice, other spurious loss factors also reduce the theoretical performance. These losses include the resistance of the copper traces on the circuit board, contact resistances, and the series resistance of the storage capacitor. These resistances are not insignificant, in view of the fact that switching resistance and loop resistance could both be several milli-ohms. Another major loss contributor is that of the transformer used to adjust the antenna impedance to an optimum, lower value.

Power Switch Driver Circuits

As discussed above, switch capacitance of power switch devices is a critical parameter to system performance, and improved high frequency performance can be achieved by negating its dissipative affect through the use of the TSS algorithm. That control algorithm applies to the capacitance associated with the output terminals of the switch (i.e., the switched terminals). There is also a substantial capacitance inherent to the input or control terminals of any electronic switch. In the case of FET switches, that capacitance is actually greater by about a factor of two than the output terminal capacitance. Its negative affect is mitigated by control voltages that are typically lower than the output terminal switched voltage; however, if ignored, performance can be degraded substantially. It is possible, by invoking the same principles of energy transfer as described above, to eliminate the dissipation that will be associated with input capacitance. Instead of dissipating the input capacitive energy in the driver switch, that energy will be transferred to another storage capacitor.

Figure 9:
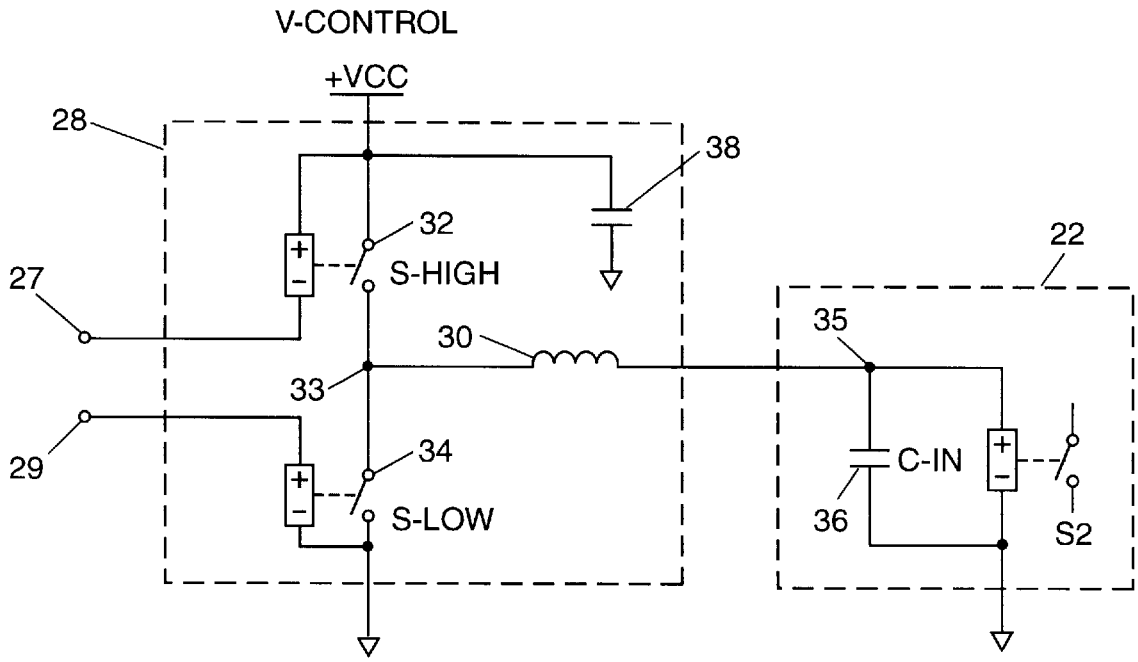
FIG. 9 shows a first embodiment of a driver circuit in accordance with the invention, which is adapted to implement sequential switching.

An example of a driver circuit configured in accordance with the invention to accomplish this result is illustrated in FIG. 9. This driver circuit 28 includes a series inductive element, shown as inductor 30, and uses a switching procedure specified pursuant to the invention. The circuit is based on a standard push-pull driver configuration that can quickly charge, or discharge, the capacitor, through a low impedance in either direction. This circuit deviates from the conventional type in that three switching operations are required for each change in output state. That contrasts with conventional driver design, where a single driver switch operation enables an output change of state.

As shown in FIG. 9, the driver circuit includes first and second driver switches 32 and 34 coupled, via the inductor 30, to a control terminal 35 of power switch device 21 (e.g., of FIG. 8). The inherent capacitance associated with the input or control terminal of power switch device 22 is represented by capacitor 36. This circuit transfers the energy from the input capacitance to a storage capacitor 38 via an intermediate storage element, i.e., the inductor 30. An alternate analytic approach is based on consideration of power dissipation avoidance by preventing simultaneous current through, and voltage across, the driver device. If switch 32 or 34 were shorted directly across a capacitor, large short-term dissipation occurs because the capacitor voltage must be continuous as a function of time. Immediately following the switch closure, the device voltage is equal to the full charged value of capacitor 36 and the current is very high because it is equal to that voltage, divided by the internal resistance of the switch device. The series inductor 30 overcomes that problem because its current must be continuous. When the driver switch 32 is first closed, the inductor current is equal to zero, and, the device voltage immediately drops to zero without any dissipation. The discharge current then builds up, but the device voltage is always near zero, thereby minimizing dissipation.

Figure 9A:
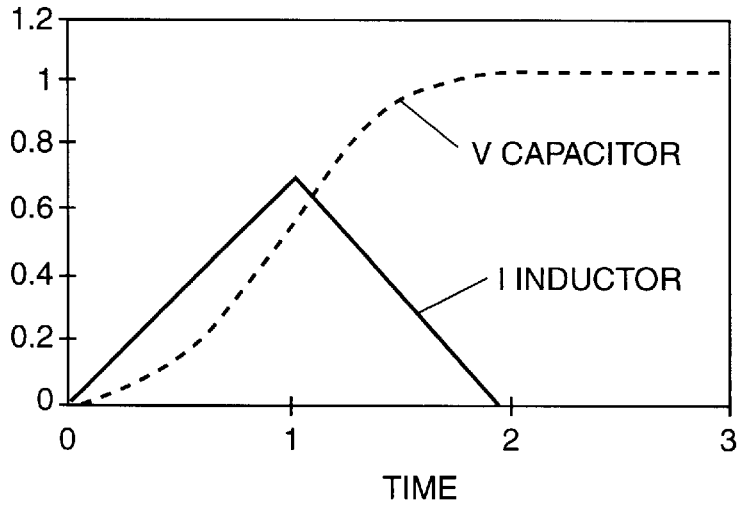
FIG. 9*a* illustrates operation of the FIG. 9 driver circuit.

More particularly, the state of power switch device 21, of FIG. 9, is changed from open to closed, i.e., from OFF to ON, by changing its gate voltage from zero to about 10 volts. It is recognized that positive control voltages are appropriate for enhancement-mode MOSFETs. However, it should be noted that the principles as described are applicable to depletion-mode devices requiring negative control voltages by modification of the supply voltages in the circuit. In the initial condition, the driver switches are OFF and ON, respectively. In order to change the output state, one first opens switch 34 and closes switch 32. As shown in FIG. 9*a*, the inductor 30 current starts to rise, and the capacitor 36 voltage slowly increases. At an intermediate time, $t_1$, driver switch 34 is closed and driver switch 32 is opened. The inductor current remains positive, but starts to fall back toward zero. The positive current continues to charge the capacitor. If the inductor value and intermediate time, $t_1$, are carefully selected, the capacitor will fully charge in the desired switching time, $t_S$ (approx.=2 time units in FIG. 9*a*). At $t=t_S$, switches 34 and 32 are cycled back to OFF and ON, respectively, and will hold the desired control state for an indefinite period to time. A similar process is followed to discharge the capacitance, and change the output switch state from ON to OFF.

Pursuant to the invention, a first embodiment of the described novel driver circuit may be characterized as follows. For use in a synthesizer radiating system, wherein power switch devices control energy transferred back and forth between antenna and storage reactances, a driver circuit is provided to change states of a power switch device. The driver circuit 28 includes first and second driver switch devices 32 and 34 in a series arrangement suitable for connection across a potential and having a common point 33 between the switch devices. An inductive element 30 is coupled at one end to such common point 33 and arranged for a second end to be coupled to a control terminal 35 of the power switch device 22, for use in changing states thereof between open and closed states. Operationally, the driver circuit 28 is arranged for sequential switching of the first and second driver switch devices 32 and 34, to enable control of the power switch device 22 while reducing dissipation of energy capacitively stored in association with the control terminal 35 of the power switch device. To accomplish such sequential switching, the driver circuit 28 is controlled by a control circuit coupled to the first and second driver switch devices 32 and 34. The control circuit is arranged to activate switch devices 32 and 34 in a sequence effective to control changes of state of the power switch device, while reducing dissipation of energy capacitively stored in association with the control terminal of the power switch device. A control circuit 74 suitable for this purpose will be described with reference to FIG. 14.

On an overview basis, the need for intermediate changes of state of the driver switch devices 32 and 34 may not be immediately apparent. Without that process, the capacitor voltage would have a tendency to "ring", causing output switch "bounce", and prolonging the switching transition time. Energy could thus oscillate back and forth between the capacitor and inductor, until it is completely dissipated by the driver switch resistance. Driver switch devices can be selected that are smaller than the output power switch devices, however their parameters must be controlled to provide acceptable performance. For a triangular-type charge or discharge current waveshape, the ratio of dissipated energy to initial stored energy is found from:

$$E_D/E_S=(8/3)t_D/t_S$$

where $t_D$ is the time constant formed by the product of the driver switch resistance and the capacitance. This equation was derived by integrating the instantaneous driver switch power ($I^2R$) over the switching duration. Consideration can be given to whether in a particular system design the dissipation of energy in the driver switch capacitance should also be addressed. With use of smaller devices, their capacitance is also smaller, and, at lower RF carrier frequencies where switching speeds are relatively slow, the effect will be minor. However, at higher freuencies, the effect must be considered. Techniques that were used to alleviate output switch capacitive-induced dissipation can also be applied here.

Figure 10:
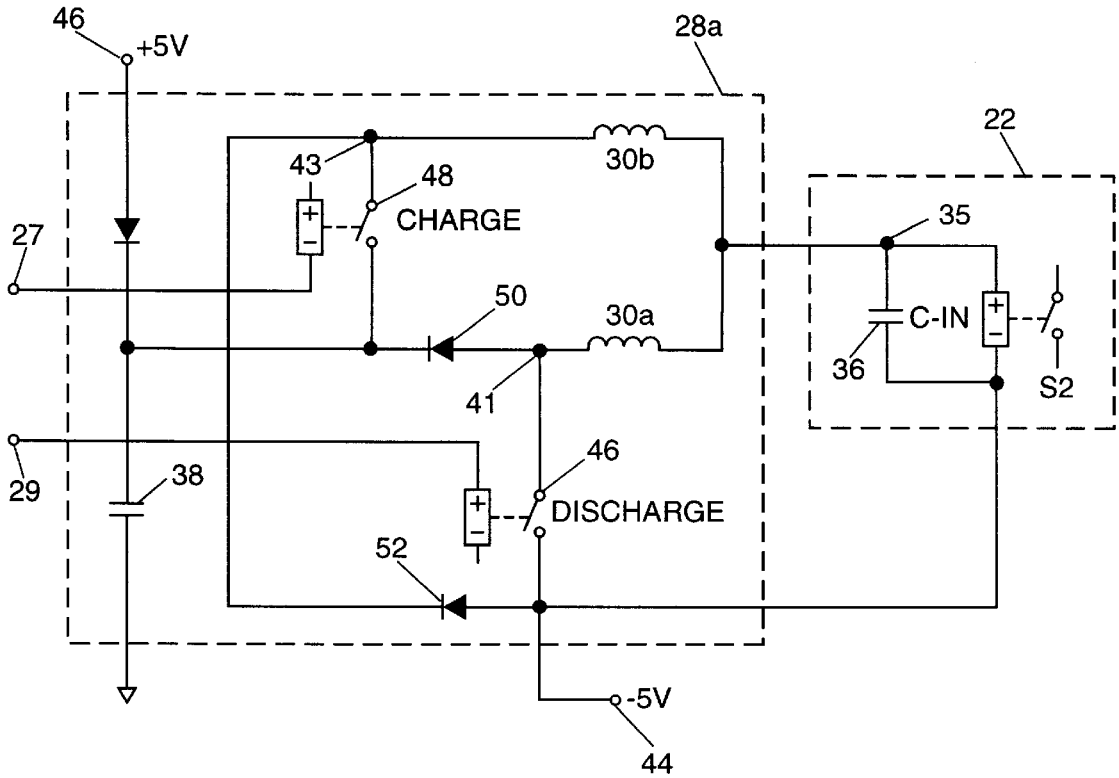
FIG. 10 shows a second embodiment of a driver circuit in accordance with the invention, which is adapted to implement sequential switching.

A second embodiment of a driver circuit in accordance with the invention is illustrated in FIG. 10. Pursuant to the preceding description, driver circuit 28*a* is usable in a synthesizer radiating system wherein a power switch device (e.g., device 22 of FIG. 8) controlling energy transfer back and forth between antenna and storage reactances has a control terminal 35 with inherent capacitance 36, as discussed with reference to FIG. 9. As shown, the FIG. 10 driver circuit includes both switch closing and switch opening circuits. In FIG. 10, the driver circuit is coupled to the control terminal 35 (e.g., of switch 22) and includes a switch opening circuit comprising a first inductance 30*a* coupled between control terminal 35 and a first circuit point 41 coupled to the storage reactance 38 and a first driver switch device 46, which is coupled between first circuit point 41 and a reference voltage point 44. The FIG. 10 switch opening circuit is arranged, upon closing the first driver switch device 46 and opening it after a first time interval, to cause the power switch device (e.g., switch 22 of FIG. 8) to change state from closed to open, while discharging energy stored in the inherent capacitance 36 by current flow to the storage reactance 38 via the first inductance, so as to limit dissipation of such stored energy. As shown in FIG. 10, the first inductance 30*a* is coupled to storage capacitance 38 via a unidirectional current flow device illustrated as diode 50 and reference voltage point 44 is a point of negative voltage.

Figure 10A:
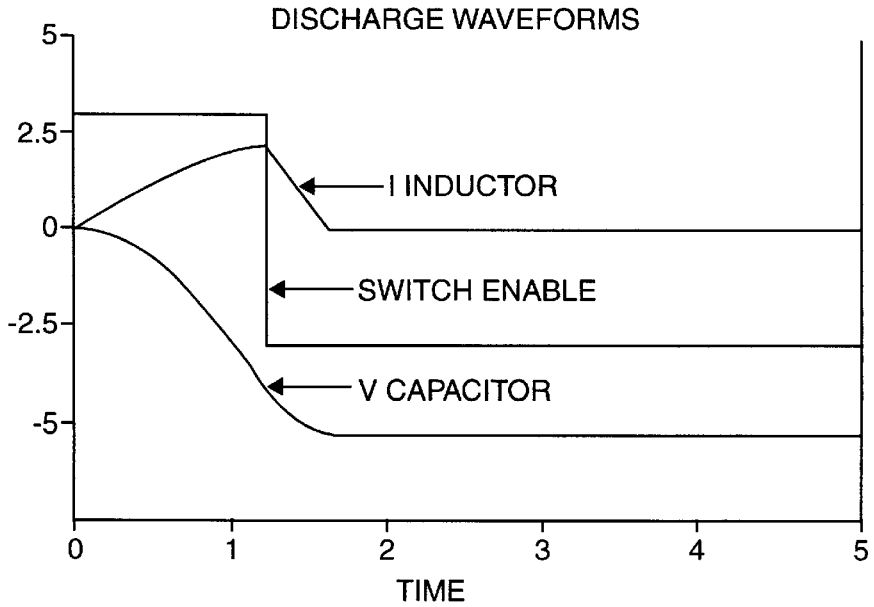
FIGS. 10*a* and 10*b* illustrate operation of the FIG. 10 circuit during power switch closing and opening cycles, respectively.

Operationally, the switch opening circuit portion of the FIG. 10 driver circuit is arranged to initiate current flow through the first inductance 30*a* upon said closing of the first driver switch device 46. With reference to FIG. 10*a*, power switch 22 of FIG. 10 is initially assumed to be closed, with its control terminal capacitance 36 charged. With closing of first driver switch 46 at time t=0 in FIG. 10*a*, the inductor 30*a* current starts to rise and capacitance 36 voltage slowly decreases. After a first time interval, at time t=1.25 approximately, first driver switch 46 is opened. The inductor 30*a* current then begins to fall to zero and the voltage across capacitance 36 continues to fall to the lower reference potential of negative 5 volts, where the state of power switch 22 changes from closed to open in the FIG. 10 example. In this manner there is thus initiated the discharge of energy stored in inherent capacitance 36, and the transfer of such energy to the storage capacitor 38 via transfer inductor 30*a* and diode 50, when discharge switch 46 is opened.

The FIG. 10 driver circuit additionally includes a switch closing circuit comprising a second inductance 30*b* coupled between the power switch device control terminal 35 and a second circuit point 43 coupled to the reference voltage point 44 and a second driver switch 48 coupled between the storage reactance 38 and second circuit point 43. The FIG. 10 switch closing circuit is arranged, upon closing of the second driver switch device 48 and opening it after a second time interval, to cause the power switch device (e.g., switch 22 of FIG. 8) to change state from open to closed, while charging the inherent capacitance 36 via the second inductance. As shown in FIG. 10, the second circuit point is coupled to the point of negative voltage via a unidirectional current flow device illustrated as diode 52.

Figure 10B:
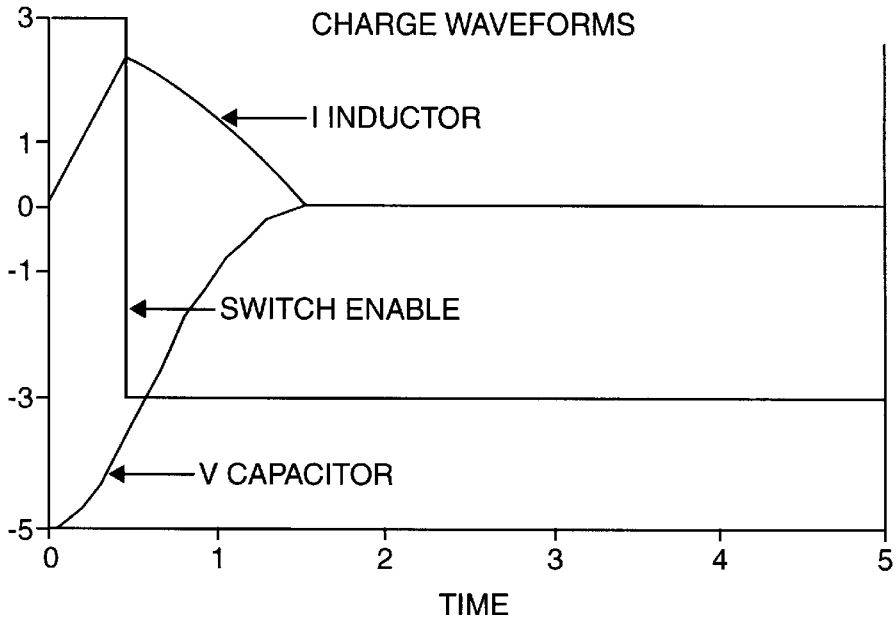

Operationally, the switch closing circuit portion of the FIG. 10 driver circuit is arranged to initiate current flow through the second inductance 30*b* upon said closing of the second driver switch 48. With reference to FIG. 10*b*, power switch 22 of FIG. 10 is initially assumed to be opened with its control terminal capacitance 36 discharged. With closing of the second driver switch 48 at time t=0 in FIG. lob, the inductor 30*b* current starts to rise and capacitance 36 voltage slowly increases. After a second time interval, at time t=0.5 approximately, second driver switch 48 is opened. The inductor 30*b* current then begins to fall to zero and the voltage across capacitance 36 continues to rise to zero, at which point the state of power switch 22 will change from open to closed. In FIGS. 10*a* and 10*b*, time is represented in seconds, voltage in volts and current in tenths of amperes. In this manner there is thus initiated the charging of the inherent capacitance 36 by transferring energy from the storage capacitor 38 via transfer inductor 30*b* and diode 52.

As the power switch 22 cycles back and forth between open and closed states, control energy passes back and forth between the control capacitance 36 and the storage capacitance 38. In the absence of resistive losses, the circuit could be switched an infinite number of times without dissipating energy. Hence, no prime power input would be required, regardless of the switching rate. In practice, small losses result in limited dissipation.

Multi-Segment Loop Systems

FIG. 2 shows a basic form of synthesizer radiating system. It uses a single switching circuit that is connected to the two input terminals of a standard loop antenna. Each switch may consist of several individual devices either connected in series or parallel in order to realize optimized performance at the desired radiation power level. At some frequencies of operation additional practical constraints may require consideration. As a first consideration, the device parameters may necessitate very low antenna input terminal impedance in order to realize acceptable performance. That impedance may not be compatible with a single-turn loop of appropriate size. One approach uses a segmented loop fed by radial transmission lines fed from a single central feed point, as described in application Ser. No. 238,568, filed Jan. 28, 1999, entitled "Low Impedance Loop Antennas" and having a common assignee. As a second consideration, a single-turn loop may be subject to an electrical resonance when the antenna is moderately small. This resonance occurs when the distance around the loop perimeter approaches one-half wavelength at an operating frequency.

Pursuant to the invention, a multi-segment loop configuration using distributed switching electronics provides a solution addressing these considerations. An embodiment in which the antenna has been broken into four segments and uses four switching circuits controlled by synchronous signals will be described. While a four-way implementation is described by way of example, the loop can be broken into any number of segments in order to realize the desired performance.

The effective terminal impedance that is presented to each sub-circuit is equal to 1/N times the total loop impedance where N is the number of segments. Hence, the optimum low-impedance antenna impedance level is achieved by dividing the loop into the appropriate number of segments. The electrical resonance of this approach occurs when each segment length approaches one-half wavelength. Therefore, the resonance is increased in frequency by a factor of N over the non-segmented approach. It is possible, using this approach to obtain acceptable performance at any frequency by properly segmenting the loop. Finally, this approach enables the center area of the loop to physically be left open. All the electronic control and power components can be packaged in a flexible ribbon that also contains the loop conductor. That mechanical implementation is compatible with excellent performance, low cost, and provides a great deal of packaging flexibility, particularly for body-borne applications. For example, the complete synthesizer radiating system can thus be mounted in or on a jacket or garment enabling the system to be carried into and operated in the field by one person in a hands-free configuration.

Figure 11:
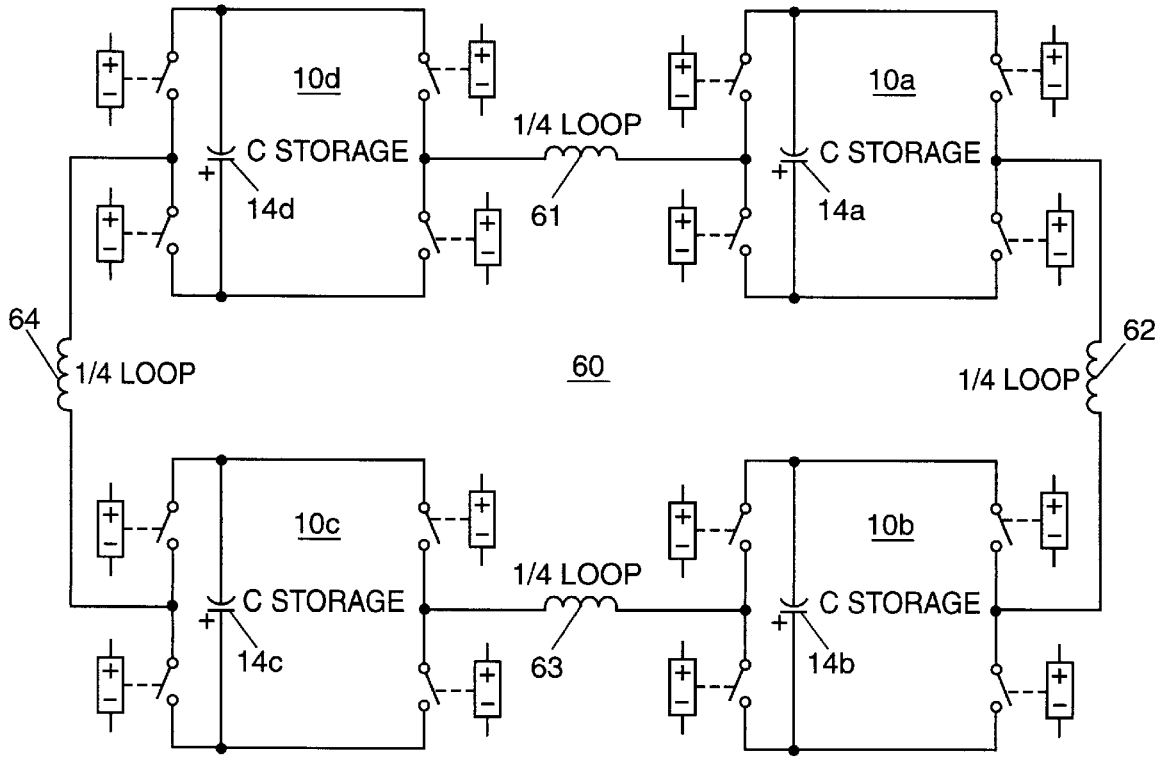
FIG. 11 illustrates a synthesizer radiating system employing a multi-segment loop radiator system in accordance with the invention.

FIG. 11 shows a synthesizer radiating system 60 employing a multi-segment loop radiator in the form of a single-turn loop separated into four segments 61–63. In FIG. 11, the single switching circuit of FIG. 2 is replaced by four switching circuits (i.e., for four "sub-circuits") 10*a*, 10*b*, 10*c*, 10*d*, each of which is coupled to the ends of two successive ones of loop segments 61–63, as shown. Each of the sub-circuits 10*a–d* may be similar to switching circuit 10 of FIG. 2, except for the described coupling to loop segments 61–63 instead of to the ends of continuous loop 12 as in FIG. 2.

Pursuant to the invention, a multi-segment loop radiator system, for use in a synthesizer radiating system 60 wherein energy is transferred back and forth between an inductive antenna element and storage capacitance by controlled activation of switching circuits, may be characterized as follows. The multi-segment loop radiator system 60 comprises a loop antenna element configured as a plurality of successive loop segments 61–63 and a like plurality of switching circuits 10*a–d* each coupled to a different pair of loop segments. Each switching circuit (i.e., sub-circuit) includes switch devices arranged for controlled activation as described above to transfer energy back and forth from the loop segments to which it is coupled to a portion of said storage capacitance (i.e., to one of capacitors 14*a–d* of FIG. 11).

Although any number of segments may be utilized pursuant to design considerations as discussed, in FIG. 11 the plurality of successive loop segments consists of four loop segments 61–63, which are employed with a like plurality of switching circuits consisting of four switching circuits 10*a–d*, each having a respective capacitor 14*a–d* coupled thereto. Thus, in FIG. 11, the basic storage capacitance comprises a plurality of capacitive devices, one coupled to each switching circuit.

In a particular implementation, the multi-segment loop radiator system as represented in FIG. 11 may be constructed as a flexible ribbon including loop segments and switching circuits physically arranged as a continuous flexible loop capable of being supported by a jacket or other article of clothing. Such an operable while wearing system may desirably include a portable receiver/transmitter and portable battery coupled to the switching circuits to comprise an individually transportable communication system. Such receiver/transmitter (e.g., as described with reference to FIG. 13 of the '133 patent) may typically be provided in miniaturized form and coupled in parallel to each of the switching circuits 10*a–d* to enable simultaneous excitation of loop segments 61–63.

System Implementation

To provide an overview, further circuit details of a synthesizer radiating system in accordance with the invention will be described. This system can be considered to be a multi-segment loop system as described with reference to FIG. 11. For ease of description a one-segment loop with a single switching circuit will be addressed, the description being readily applicable to the multi-segment configuration. Particular circuit components critical to the invention have already been identified, discussed and specifically referenced to circuit units in the various figures. The following description will, therefore, refer to illustrated circuits in an overview manner to instruct skilled persons regarding system implementation.

Figure 12:
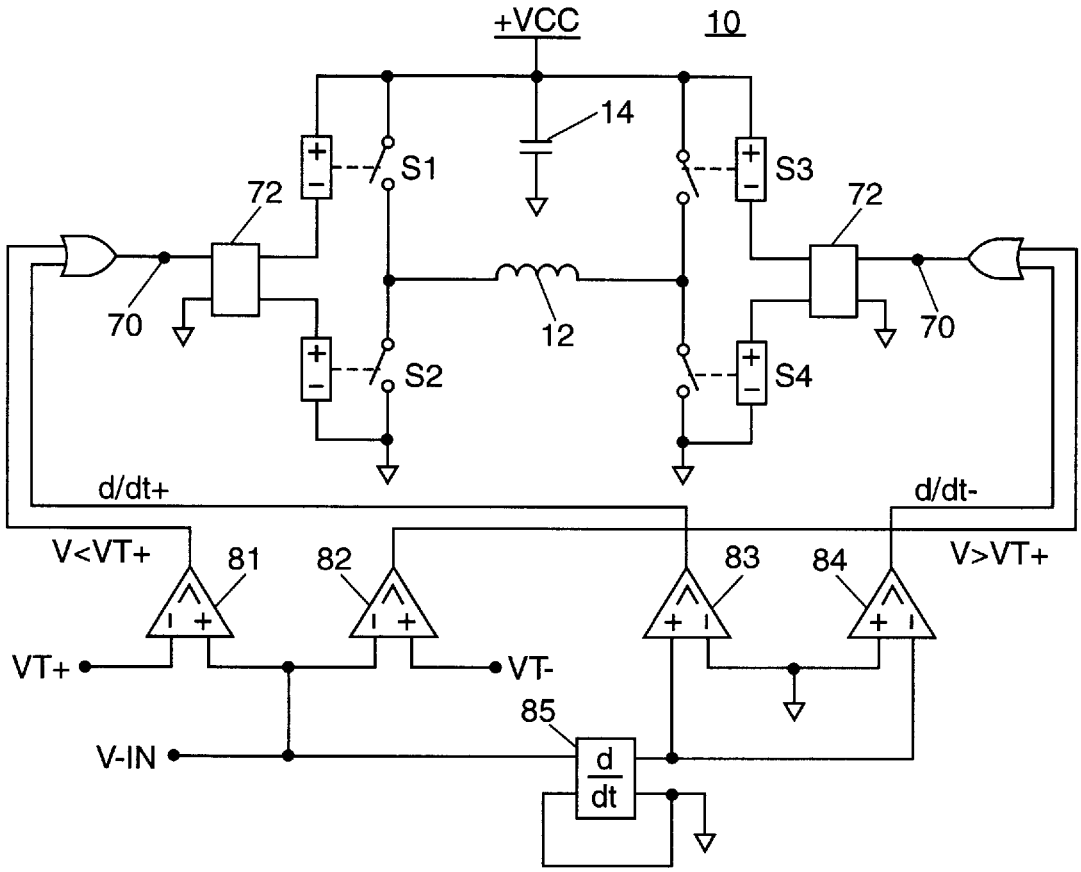
FIG. 12 is an overview of a complete synthesizer radiating system in accordance with the invention.

A block diagram of a synthesizer radiating system is shown in FIG. 12. The input is a constant envelope voltage waveform. The peak voltage is a specified value that will be independent of output power level. Power control is accomplished by a separate control line that will adjust $V_{CC}$.

Figure 13:
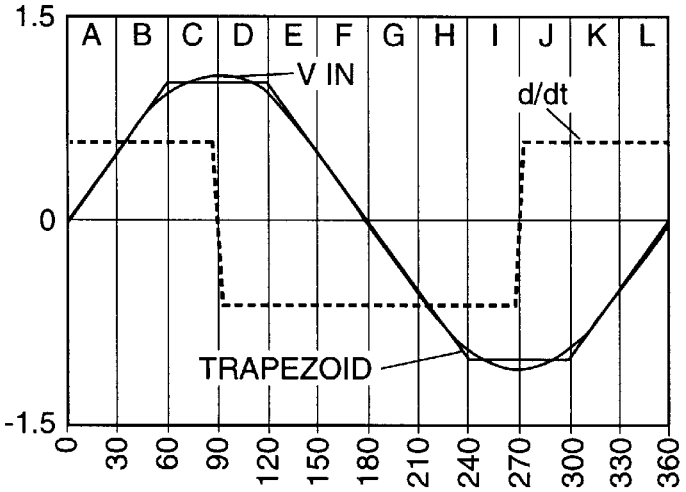
FIG. 13 provides a switch table useful in understanding operation of the FIG. 12 system in synthesizing a sinusoidal-type waveform.

A trapezoidal waveform is illustrated in FIG. 13, and the various regions of the control process are indicated. Since each pair of switches (i.e., S1/S2 and S3/S4) always switches in a coordinated manner, and each pair is anti-phase, a common control/driver circuit 72 is used for each pair. The control/driver circuit 72 implements sequential switching by delaying the appropriate short-circuit transition until after the open circuit transition has been made as described. That process occurs for each change of state in the input driver logic signals provided at input terminal 70 of circuit 72, such logic signals and transitions indicated in the FIG. 13 logic table.

The logic transition points are determined by two characteristics. The first parameter is the point at which the input waveform slope changes polarity. That is found by differentiating the input in differentiator 85 of FIG. 12. The second parameter is whether the input voltage exceeds some predetermined positive and negative voltage thresholds. Those conditions are obtained by the use of voltage comparators 81–84. The slope and threshold conditions are logic ORed to provide the driver input logic signal at terminal 70. In the transition regions the driver control logic changes state. These are the regions where the staggered switching occurs.

Figure 14:
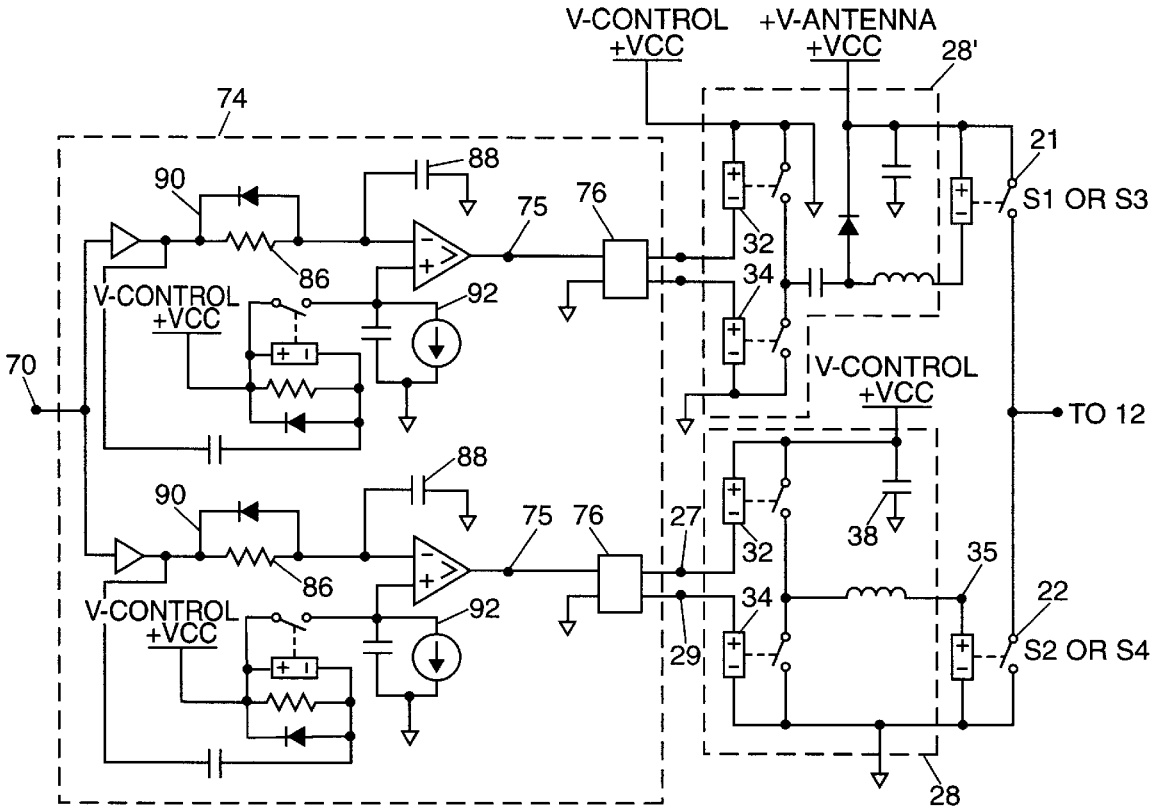
FIG. 14 illustrates application of control and driver circuits pursuant to the invention to a pair of power switches of the FIG. 12 system.

A block diagram of control/driver circuit 72, representing the combination of control circuit 74 and driver circuits 28 and 28', is shown in FIG. 14. The driver circuits 28' and 28 for the high and low-side power switches 21 and 22, respectively, are identical except that they are driven anti-phase by inverting and non-inverting buffers. In addition, the high-side driver 28' is AC coupled to switch 21 because its output must be level-shifted and clamped to the antenna supply voltage. In operation of control unit 74, sequential switching is accomplished by components 86 and 88 arranged to provide an RC delay on positive transitions. A positive control voltage corresponds to a closed output switch. The diode inhibits delay on negative transitions. The one-way delay circuits 90 enable the switch open transition to always occur before the close transition, with the differential time dependent on the RC time constant.

For wide-band waveforms the lower frequency components require a shorter differential time in the sequential switching. That is necessary because the lower impedance, exhibited at lower frequency components, results in larger currents that charge the switch capacitance at a faster rate. The frequency compensation circuit 92 corrects that problem by responding to the longer dwell times at lower frequencies. When the logic transitions to a low state, the comparator reference voltage is reset to $V_{CONTROL}$. The negative-going edge momentarily turns on the switch, pulling the reference terminal to $V_{CONTROL}$. The current source then gradually discharges the capacitor across the reference terminal. The longer the negative dwell time, the lower the reference voltage becomes. A lower reference voltage results in a shorter positive transition delay.

Figure 15:
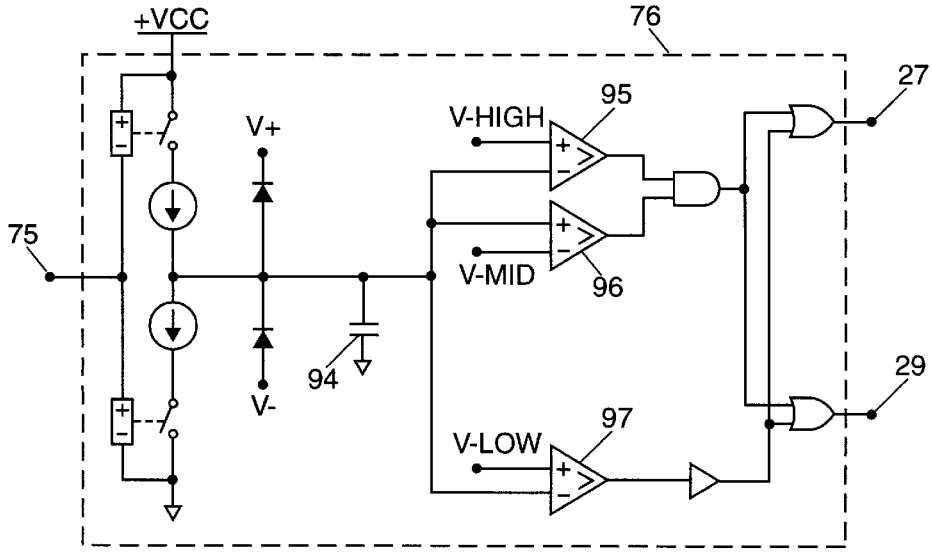
FIG. 15 illustrates a form of sequence circuit included in the control circuit of FIG. 14.

The FIG. 14 control circuit 74 includes two sequence circuits 76. The sequence circuits 76 cycle the driver circuits 28' and 28 through the three switching states described above that are needed to prevent input switch capacitance dissipation. A block diagram of a sequence circuit is shown in FIG. 15. At each logic transition a voltage ramp is generated by either charging or discharging a capacitor 94 between Vcc and ground with constant current sources. Comparators 95–97 partition the voltage into 4 possible regions, and output logic signals at terminals 27 and 29 control the two driver switches (e.g., switches 32 and 34 of driver 28). As the ramp progresses, the switches cycle through the switch states. The dwell times in each region of the ramp are determined by the current magnitude, capacitor value, and the comparator voltage thresholds.

The entire synthesizer system as illustrated has been carefully designed to contain the same number of logic gates and comparators in every possible signal path from the input to an output switch. In that way component delay does not degrade the integrity of the control algorithm, but only results in an overall delay between presentation of an input desired signal and the radiated waveform. High speed components with transition times on the order of a few nanoseconds should typically be used. The entire system lends itself to ready conversion to a general ASIC type of integrated circuit, with time constants adjusted by external resistors or capacitors, by skilled persons having an understanding of the invention.

It should be noted that this is only one of many possible implementations. Other implementations might exclusively contain digital hardware instead of the analog comparator circuits shown. Digital noise from a very high speed clock and overall power consumption would be considerations in such implementations. While there have been described the currently preferred embodiments of the invention, those skilled in the art will recognize that other and further modifications may be made without departing from the invention and it is intended to claim all modifications and variations as fall within the scope of the invention.

SEQUENCE LISTING

Not Applicable

What is claimed is:

1. A synthesizer radiating system, wherein energy is transferred back and forth between an inductive antenna element and storage capacitance by controlled activation of switching circuits, comprising:

a multi-segment loop radiator system including a loop antenna element configured as a plurality of successive loop segments, and a like plurality of switching circuits each coupled to a different pair of loop segments, each switching circuit including power switch devices arranged for controlled activation to transfer energy back and forth from the loop segments to which it is coupled to a portion of said storage capacitance; and a driver circuit usable to change states of a selected power switch device including first and second driver switch devices in a series arrangement suitable for connection across a potential and having a common point between said driver switch devices, and an inductive element coupled at one end to said common point and arranged for a second end to be coupled to a control terminal of said selected power switch device for use in changing states thereof between open and closed states;

the synthesizer radiating system arranged to employ a sequential switching method including the steps of (a) initially providing one power switch device in an open state with a voltage across it and energy capacitively stored therein, (b) initially providing another power switch device in a closed state, and coupled, to the open switch so that the state of the closed switch affects the voltage across the open switch, (c) reducing the voltage across the open switch by changing the state of the closed switch from closed to open, and (d) changing the state of the open switch from open to closed at a predetermined time after changing the state of the closed switch in step (c).

2. In a synthesizer radiating system, wherein energy is transferred back and forth between an inductive antenna element and a storage capacitance by controlled activation of switch devices including power switch devices in series across a potential with a common point between said power switch devices coupled to a point on the antenna element, a sequential switching method comprising the steps of:

(a) initially providing one power switch device in an open state with a voltage across it and energy capacitively stored therein;

(b) initially providing another power switch device in a closed state;

(c) changing the state of the closed switch from closed to open to thereby reduce the voltage across the open switch; and (d) a predetermined time after step (c), changing the state of the open switch from open to closed.

3. A sequential switching method as in claim 2, wherein said system further includes first and second additional power switch devices in series across a potential with a common point between said additional power switch devices coupled to a second point on the antenna element, and wherein step (a) additionally includes initially providing the first and second additional power switch devices in respective closed and open states.

4. A sequential switching method as in claim 3, including the additional step of:

(e) during operation of the system, before closing any one of said power switch devices, opening a different power switch device in a sequential manner consistent with steps (c) and (d) to reduce voltage across the power switch device to be closed, before it is closed.

5. A sequential switching method as in claim 2, wherein step (c) comprises:

(c) changing the state of the closed switch from closed to open to thereby reduce the voltage across the open switch in a gradual manner determined by current flow through said inductive antenna element.

6. In a synthesizer radiating system, wherein switch devices control energy transferred back and forth between antenna and storage reactances and wherein closing of a switch device with energy capacitively stored therein would dissipate such stored energy, a sequential switching method comprising the steps of:

(a) initially providing one switch device in an open state with a voltage across it and energy capacitively stored therein;

(b) initially providing another switch device in a closed state, and coupled to the open switch so that the state of the closed switch affects the voltage across the open switch;

(c) reducing the voltage across the open switch by changing the state of the closed switch from closed to open; and (d) changing the state of the open switch from open to closed at a predetermined time after changing the state of the closed switch in step (c).

7. A sequential switching method as in claim 6, wherein said system includes a plurality of switch devices to control energy transfer between antenna and storage reactances and wherein each closing of one of said switch devices is preceded by the opening of a different switch as provided by steps (a) through (d) so as to reduce the voltage across the switch device to be closed, before it is closed.

8. A sequential switching method as in claim 6, wherein in step (b) the closed switch is coupled to a potential via an inductance and step (c) comprises:

(c) reducing the voltage across the open switch in a gradual manner determined by current flow through said inductance caused by changing the state of the closed switch from closed to open.

9. In a synthesizer radiating system, wherein power switch devices control energy transferred back and forth between antenna and storage reactances, a driver circuit usable to change states of a power switch device comprising:

first and second driver switch devices in a series arrangement suitable for connection across a potential and having a common point between said switch devices; and an inductive element coupled at one end to said common point and arranged for a second end to be coupled to a control terminal of said power switch device for use in changing states thereof between open and closed states.

10. A driver circuit as in claim 9, arranged for sequential switching of said first and second driver switch devices, to enable control of said power switch device while reducing dissipation of energy capacitively stored in association with said control terminal of the power switch device.

11. A driver circuit as in claim 9, wherein the side of said first driver switch device away from said common point is coupled to a storage capacitor.

12. A driver circuit as in claim 9, additionally comprising:

a control circuit coupled to said first and second driver switch devices and arranged to activate said devices in a sequence effective to control changes of state of said power switch device, while reducing dissipation of energy capacitively stored in association with said control terminal of the power switch device.

13. In a synthesizer radiating system, wherein a power switch device controlling energy transfer back and forth between antenna and storage reactances has a control terminal with inherent capacitance, a driver circuit coupled to said control circuit and including a switch opening circuit comprising:

a first inductance coupled between said control terminal and a first circuit point coupled to a storage capacitance; and a first driver switch device coupled between said first circuit point and a reference voltage point;

the switch opening circuit arranged, upon closing the first driver switch device and opening it after a first time interval, to cause the power switch device to change state from closed to open, while discharging energy stored in said inherent capacitance by current flow to the storage capacitance via said first inductance so as to limit dissipation of such stored energy.

14. A driver circuit as in claim 13, wherein said first inductance is coupled to said storage capacitance via a unidirectional current flow device.

15. A driver circuit as in claim 13, wherein said reference voltage point is a point of negative voltage.

16. A driver circuit as in claim 13, wherein the switch opening circuit is arranged to initiate current flow through the first inductance upon said closing of the first driver switch, to initiate thereby said discharge of energy stored in said inherent capacitance to activate opening of the power switch device in response to said opening of the first driver device after the first time interval.

17. A driver circuit as in claim 13, additionally including a switch closing circuit comprising:

a second inductance coupled between said control terminal and a second circuit point coupled to said reference voltage point; and a second driver switch device coupled between the storage reactance and said second circuit point;

the switch closing circuit arranged, upon closing of the second driver switch device and opening it after a second time interval, to cause the power switch device to change state from open to closed, while charging said inherent capacitance via said second inductance.

18. A driver circuit as in claim 17, wherein said reference voltage point is a point of negative voltage and said second circuit point is coupled thereto via a unidirectional current flow device.

19. A driver circuit as in claim 17, wherein the switch closing circuit is arranged to initiate current flow through the second inductance upon said closing of the second driver switch, to initiate thereby said charging of said inherent capacitance to activate closing of the power switch device in response to said opening of the second driver switch after the second time interval.

20. In a synthesizer radiating system, wherein energy is transferred back and forth between an inductive antenna element and storage capacitance by controlled activation of switching circuits, a multi-segment loop radiator system comprising:

a loop antenna element configured as a plurality of successive loop segments a like plurality of switching circuits each coupled to a different pair of loop segments, each switching circuit including switch devices arranged for controlled activation to transfer energy back and forth from the loop segments to which it is coupled to a portion of said storage capacitance.

21. A multi-segment loop radiator system as in claim 20, wherein said storage capacitance comprises a plurality of capacitive devices, one coupled to each said switching circuit.

22. A multi-segment loop radiator system as in claim 20, wherein said plurality of successive loop segments consists of four loop segments and said like plurality of switching circuits consists of four switching circuits, each having a capacitor coupled thereto.

23. A multi-segment loop radiator system as in claim 20, wherein said loop segments and switching circuits are physically arranged as a continuous flexible loop capable of being supported by an article of clothing.

24. A multi-segment loop radiator system as in claim 23, wherein the system includes a portable receiver/transmitter and portable battery coupled to said switching circuits to comprise a communication system capable of being transported by a person.

25. A multi-segment loop radiator system as in claim 24, wherein said receiver/transmitter is coupled in parallel to each of the switching circuits.

* * * * *